US009295899B1

(12) United States Patent
Dixon, Jr.

(10) Patent No.: US 9,295,899 B1
(45) Date of Patent: Mar. 29, 2016

(54) FIELD VIEW BATTING CAGE APPARATUS

(71) Applicant: Nicholas E. Dixon, Jr., Albertville, AL (US)

(72) Inventor: Nicholas E. Dixon, Jr., Albertville, AL (US)

( * ) Notice: Subject to any disclaimer, the term of this patent is extended or adjusted under 35 U.S.C. 154(b) by 0 days.

(21) Appl. No.: 14/121,548

(22) Filed: Sep. 17, 2014

Related U.S. Application Data

(60) Provisional application No. 61/961,457, filed on Oct. 15, 2013.

(51) Int. Cl.

| | |
|---|---|
| ***A63B 67/00*** | (2006.01) |
| ***A63B 71/02*** | (2006.01) |
| *A63B 69/36* | (2006.01) |
| *A63B 69/00* | (2006.01) |
| *A63B 61/00* | (2006.01) |

(52) U.S. Cl.
CPC ..... *A63B 71/022* (2013.01); *A63B 61/00* (2013.01); *A63B 69/0002* (2013.01); *A63B 69/0079* (2013.01); *A63B 69/3694* (2013.01); *A63B 71/02* (2013.01)

(58) Field of Classification Search
CPC ..... A63B 71/022; A63B 61/00; A63B 61/04; A63B 69/0002; A63B 69/0075; A63B 69/0079; A63B 71/02; A63B 69/3694
USPC ..... 473/421, 197; 135/128, 121
See application file for complete search history.

(56) References Cited

U.S. PATENT DOCUMENTS

| | | | | |
|---|---|---|---|---|
| 4,733,865 | A | 3/1988 | Reed | |
| 4,941,662 | A | 7/1990 | DePerna | |
| 4,948,141 | A * | 8/1990 | Newman | A63B 69/3694 473/421 |
| 5,634,638 | A * | 6/1997 | Havens | A63B 71/022 135/128 |
| 5,655,766 | A * | 8/1997 | Klebe, Jr. | A63B 71/022 473/197 |
| 6,550,491 | B1 * | 4/2003 | Bixler | A63B 71/022 473/421 |
| 2005/0020389 | A1 * | 1/2005 | Peterson | A63B 71/022 473/421 |
| 2005/0101419 | A1 * | 5/2005 | Pohrer | A63B 61/00 473/421 |
| 2014/0221128 | A1 * | 8/2014 | Ferraro | A63B 69/0002 473/421 |

* cited by examiner

*Primary Examiner* — Mitra Aryanpour
(74) *Attorney, Agent, or Firm* — John R. Flanagan

(57) ABSTRACT

A field view batting cage apparatus includes a support frame surrounding a foreshortened baseball playing field with baseball hitting and pitching positions in diagonally opposite corners of the field, and a netting suspended so as to form a plurality of vertical walls of netting and a ceiling of netting surrounding and overlying the field for providing containment of the baseball. The batting cage apparatus also includes either a plurality of cables strung on the support frame so as to suspend the netting to form the vertical walls of netting and a dome-shaped ceiling of netting, or a support roof attached to, and spanning diagonally between opposite corners of the support frame and at least one cable strung on the support frame so as to suspend the netting to form a dome-shaped ceiling of netting and the vertical walls of netting.

30 Claims, 16 Drawing Sheets

FIELD VIEW BATTING CAGE APPARATUS

This patent application claims the benefit of U.S. provisional application No. 61/961,457 filed Oct. 15, 2013. The disclosure of said provisional application is hereby incorporated herein by reference thereto.

BACKGROUND OF THE INVENTION

1. Field of the Invention

The present invention generally relates to batting cages and, more particularly, is concerned with a field view batting cage apparatus.

2. Description of the Prior Art

The traditional shape of batting cages is a long and narrow shaped enclosure structure with front, rear and opposite side walls and a top. The structure is typically formed of netting suspended between and hanging from a rectangular framework of piping or tubes. The standard sizes often utilized are 10'W×10'H×60'L, 12'W×12'H×60'L, 14'H×12'H×70'L and so forth. The custom shape of these structures is that the length of the structure is normally 3 to 5 times the width.

The long and narrow configuration of these structures is the main reason that they limit and inhibit a batter's ability to receive maximum benefits and skill development from practice in them. The long and narrow layout of traditional batting cages limits ball travel. Specifically, in this traditional shaped batting cage the forward travel of a batted ball is restricted to 60 degrees directly in front of the batter.

The inventor herein has perceived a pressing need for an innovation that improves the shape and construction of batting cages used for batting practice.

SUMMARY OF THE INVENTION

The present invention provides a field view batting cage apparatus designed to overcome the above-described drawbacks and satisfy the aforementioned need. Underlying the present invention is the insight originated by the inventor herein, namely, since baseball (including softball) is not played on a long, narrow tunnel shaped field, why is batting practice carried out in one, especially when it limits batting skill, development. The field view batting cage apparatus, having a square configuration that encloses a square-shaped foreshortened baseball playing field, gives a batter practicing batting a true sensation of hitting on an actual baseball playing field. It affords batters an environment that closely emulates and simulates hitting on an actual playing field. The forward travel of a batted ball is not restricted to 60 degrees directly in front of the batter; instead, now the batted ball can travel forwardly in any direction on a 180 degree arc between left and right field foul lines, the same as on an actual playing field.

Accordingly, in one aspect the present invention is directed to a field view batting cage apparatus which includes a support frame adapted to stand upright upon a support surface, a plurality of cables strung on the support frame, and a netting suspended from the support frame by the plurality of cables. The support frame has four corners with upper end portions at a given height above the support surface and in a square configuration defining a perimeter of the support frame that surrounds a foreshortened baseball playing field on the support surface. The foreshortened baseball playing field has one position disposed adjacent to and spaced inwardly of one of the corners from which to hit a baseball and another position disposed adjacent to and spaced inwardly of another of the corners being diagonally opposite to the one corner from which to pitch a baseball toward the one position. The suspended netting forms four vertical walls of netting and a ceiling of netting for providing containment of the baseball. The vertical walls of netting are suspended from at least one of the cables so as to extend between adjacent ones of the corners and along sides of the support frame such that the vertical walls of netting are inwardly spaced from, and within the perimeter of, the support frame so as to enclose four sides of the foreshortened baseball playing field. The ceiling of netting is suspended from others of the cables so as to span both laterally and diagonally between the corners of the support frame and from the vertical walls of netting such that the ceiling of netting extends toward the given height of the upper end portions of the corners of the support frame so as to have an elevated central portion providing the ceiling of netting with a dome-shaped configuration spaced above and extending over the foreshortened baseball playing field.

In another aspect the present invention is directed to a field view batting cage apparatus which includes a support frame adapted to stand upon a support surface, a roof frame attached to, and spanning the support frame, at least one cable strung on the support frame, and a netting suspended from the at least one cable and from the roof frame. The support frame has four corners with upper end portions at a given height above the support surface and in a square configuration defining a perimeter of the support frame that surrounds a foreshortened baseball playing field on the support surface having one position disposed adjacent to and spaced inwardly of one of the corners from which to hit a baseball and another position disposed adjacent to and spaced inwardly of another of the corners being diagonally opposite to the one corner from which to pitch a baseball toward the one position. The roof frame is attached to, and spans between diagonally opposite ones of, the upper end portions of the corners of the support frame such that the roof frame extends above the given height of the upper end portions of the corners of the support frame so as to have a central dome-shaped configuration spaced above and extending over the foreshortened baseball playing field. The suspended netting forms four vertical walls of netting and a ceiling of netting for providing containment of the baseball. The vertical walls of netting are suspended from the at least one cable so as to extend between adjacent ones of the corners and along sides of the support frame such that the vertical walls of netting are inwardly spaced from, and within the perimeter of, the support frame so as to enclose four sides of the foreshortened baseball playing field. The ceiling of netting is suspended from the roof frame so as to span both laterally and diagonally between the upper end portions of the corners of the support frame such that the ceiling of netting extends from the vertical walls of netting along and below the roof frame and above the given height of the upper end portions of the corners of the support frame so as to have a central elevated portion providing the ceiling of netting with a dome-shaped configuration spaced above and extending over the foreshortened baseball playing field.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
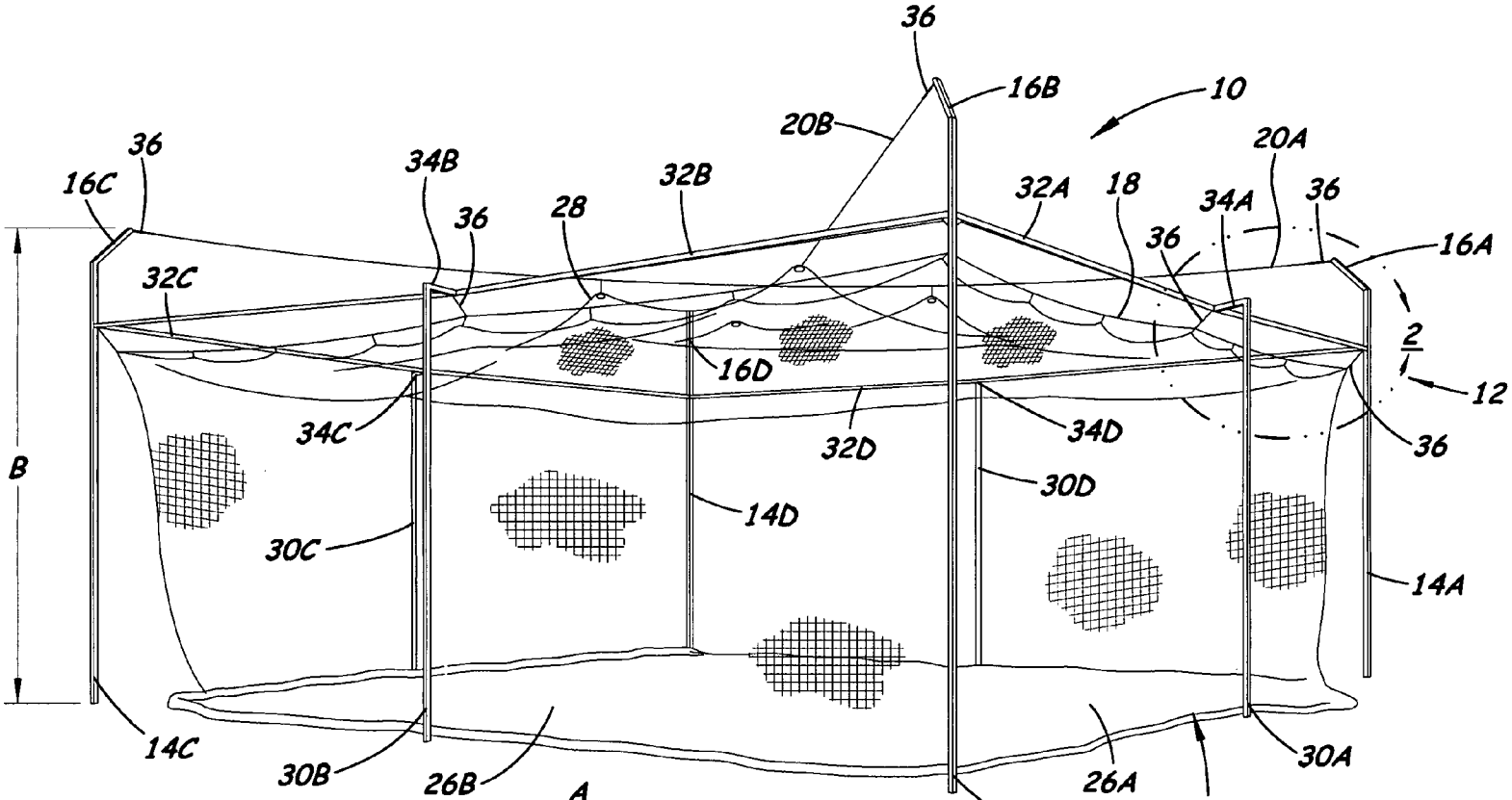
FIG. 1 is a perspective view of one exemplary embodiment of a field view batting cage apparatus in accordance with the present invention.
Figure 2:
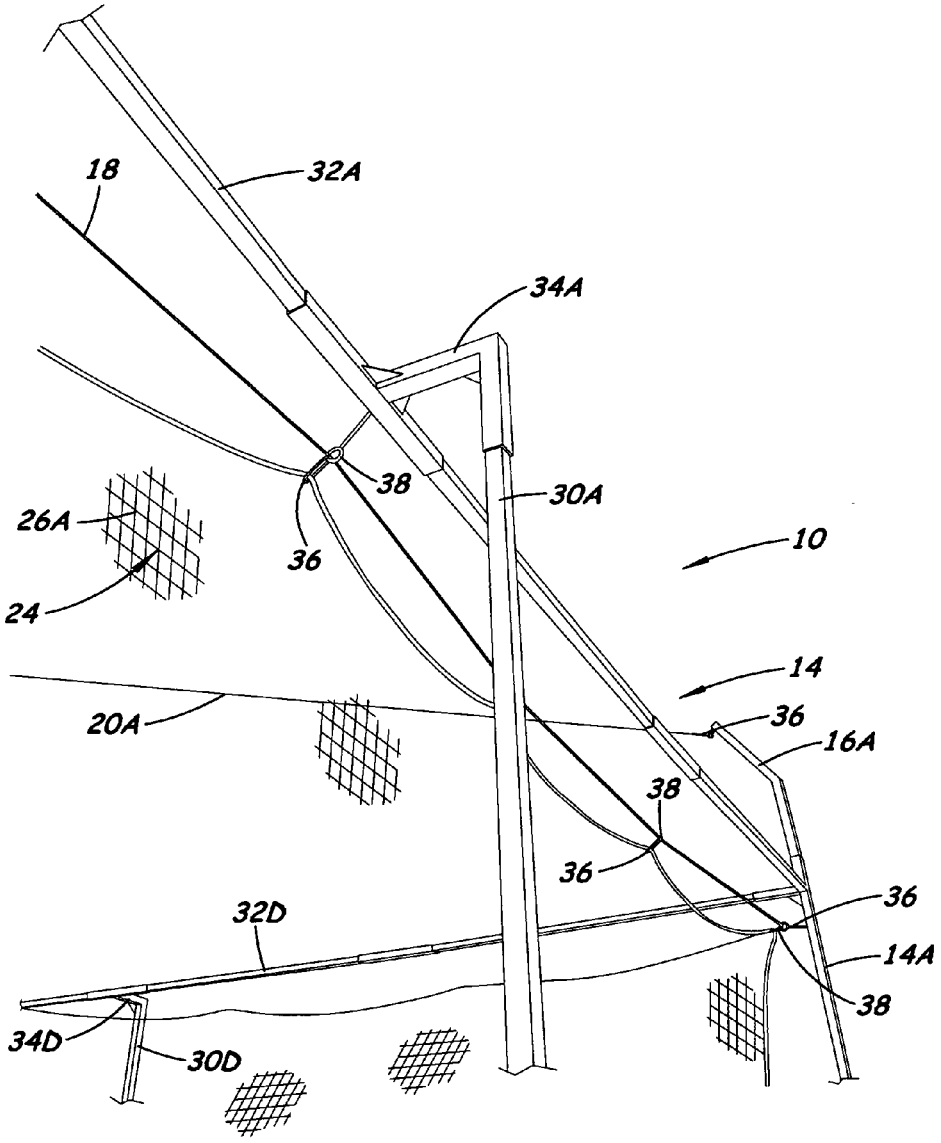
FIG. 2 is an enlarged perspective view of a portion of a side and corner of the batting cage apparatus approximately bounded by the circle 2 in FIG. 1.
Figure 3:
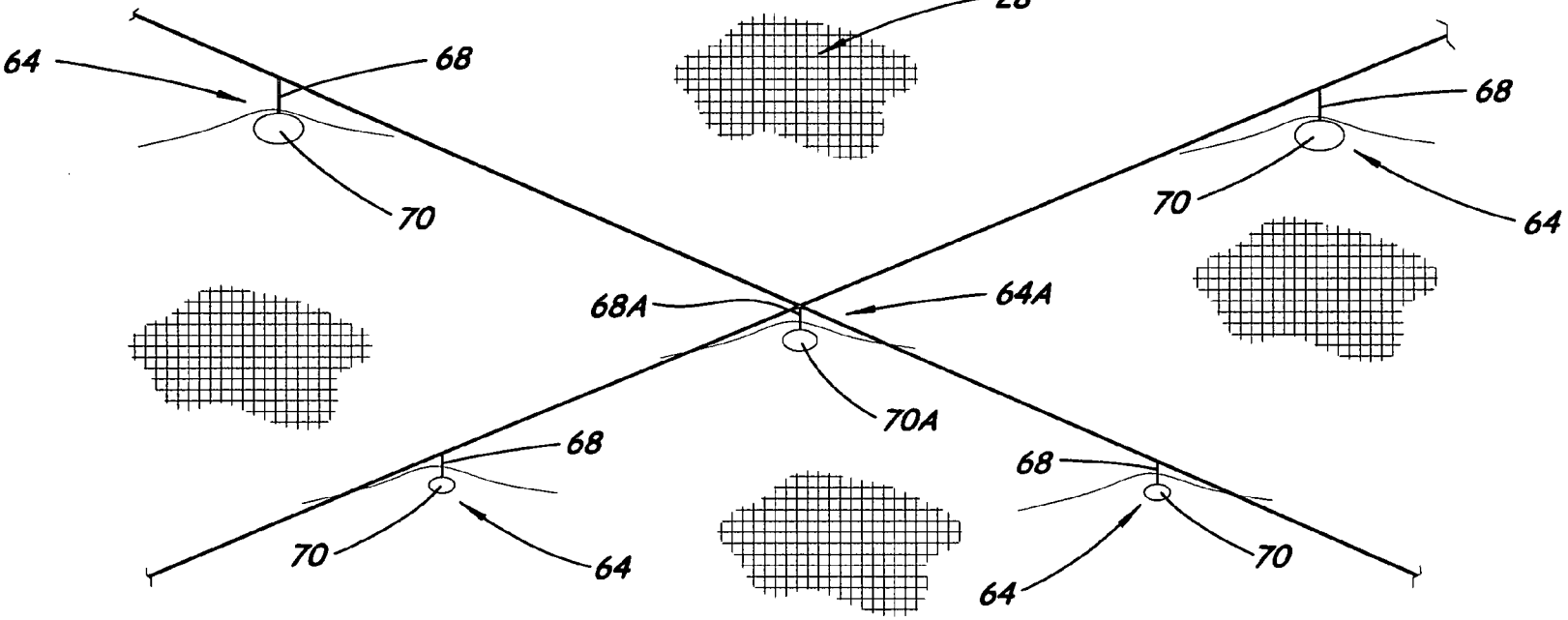
FIG. 3 is an enlarged fragmentary perspective bottom view of the batting cage apparatus of FIG. 1 depicting the underside of a ceiling of netting of the batting cage apparatus and a pair of crisscross cables that lift the ceiling of netting into a dome-shaped configuration.

Referring to the drawings, and particularly to FIGS. 1-3, there is illustrated one exemplary embodiment of a field view batting cage apparatus, generally designated 10, in accordance with the present invention. The usage of the term "ball" or "baseball" hereinafter is in a generic sense that also encompasses the term "softball".

The field view batting cage apparatus 10 includes a support frame 12 adapted to stand upright upon a support surface A, as best seen in FIG. 1. The support frame 12 has four corners 14A-14D terminating in upper end portions 16A-16D bent inwardly and extending upwardly to a given height B above the support surface A. The four corners 14A-14D are arranged in a square configuration defining a perimeter C (see FIG. 7) of the support frame 12 that is spaced outwardly from and surrounds a foreshortened baseball playing field D (as also seen FIG. 7) on the support surface A. The foreshortened baseball playing field D has one position E disposed adjacent to and spaced inwardly of the corner 14A of the support frame 12 from which to hit a baseball and another position F disposed adjacent to and spaced inwardly of the corner 14C of the support frame 12 being diagonally opposite to the one corner 14A from which to pitch a baseball toward the one position E.

The field view batting cage apparatus 10 also includes a plurality of cables strung on the support frame 12, namely, a peripheral cable 18 and a pair of crisscross cables 20A, 20B (extending corner to corner and crossing one another). The field view batting cage further includes a netting 24 suspended from the support frame 12 by the peripheral cable 18 and the crisscross cables 20A, 20B. Specifically, peripheral portions of the netting 24 are suspended by the peripheral cable 18 to form a plurality (namely, four in number) of vertical walls of netting 26A-26D extending between adjacent ones of the corners 14A-14D of the support frame 12 along sides of the playing field D. A central portion of the netting 24 is suspended by the crisscross cables 20A, 20B to form a dome-shaped ceiling of netting 28 that extends over the playing field D for providing containment of the baseball within the batting cage apparatus 10. (In various of the figures of the drawings, portions of the netting 24 have been omitted for purposes of clarity and convenience in illustration.)

More particularly, the peripheral cable 18 is anchored to the corners 14A-14D of the support frame 12 at locations below the upper end portions 16A-16D of the corners 14A-14D and runs substantially horizontally and laterally between the corners 14A-14D of the support frame 12 such that the peripheral cable 18 defines a square configuration spaced inwardly from and within the square configuration of the perimeter C defined by the support frame 12 (see FIG. 7). Thus, the peripheral portions of the netting 24 forming the vertical walls of netting 26A-26D suspended by the peripheral cable 18 are spaced inwardly from and within the perimeter C of the support frame 12 so as to enclose the foreshortened baseball playing field D. The crisscross cables 20A, 20B are anchored to the upper end portions 16A-16D of the corners 14A-14D of the support frame 12 such that the central portion of the netting 24 forming the ceiling of netting 28 suspended by the crisscross cables 20A, 20B spans both laterally from and between the vertical walls of netting 26A-26D and diagonally from and between the upper end portions 16A-16D of the corners 14A-14D of the support frame 12 such that the ceiling of netting 28 below the location of crossing of the crisscross cables 20A, 20B extends upwardly toward the given height B of the upper end portions 16A-16D of the corners 14A-14D of the support frame 12 so as to provide a central dome-shaped configuration spaced above and extended over the foreshortened baseball playing field D.

More particularly, the corners 14A-14D of the support frame 12 are in the form of four corner support frame members 14A-14D (such as legs or poles) adapted to stand upright upon the support surface A. The support frame 12 also includes four middle support frame members 30A-30D (such as legs or poles) adapted to stand upright upon the support surface A and being disposed intermediately between and spaced from the corner support frame members 14A-14D. The support frame 12 further includes four top support frame members 32A-32D (such as beams) extending horizontally between and fixedly secured to the corner support frame members 14A-14D at locations shaped below the upper end portions 16A-16D of the corner support frame members 14A-14D. The top support frame members 32A-32D also extend horizontally past and are fixedly secured to inwardly angled upper portions 34A-34D of the middle support frame members 30A-30D such that the top support frame members 32A-32D together with the corner support frame members 14A-14D and the middle support frame members 30A-30D form the support frame 12 with a rigid structure and the square configuration. The corner, middle and top support frame members 14A-14D, 30A-30D and 32A-32D may be fabricated from any suitable material, by way of example but not of limitation, such as square aluminum or steel tubing. The netting may be forty-two weight poly netting.

Figure 7:
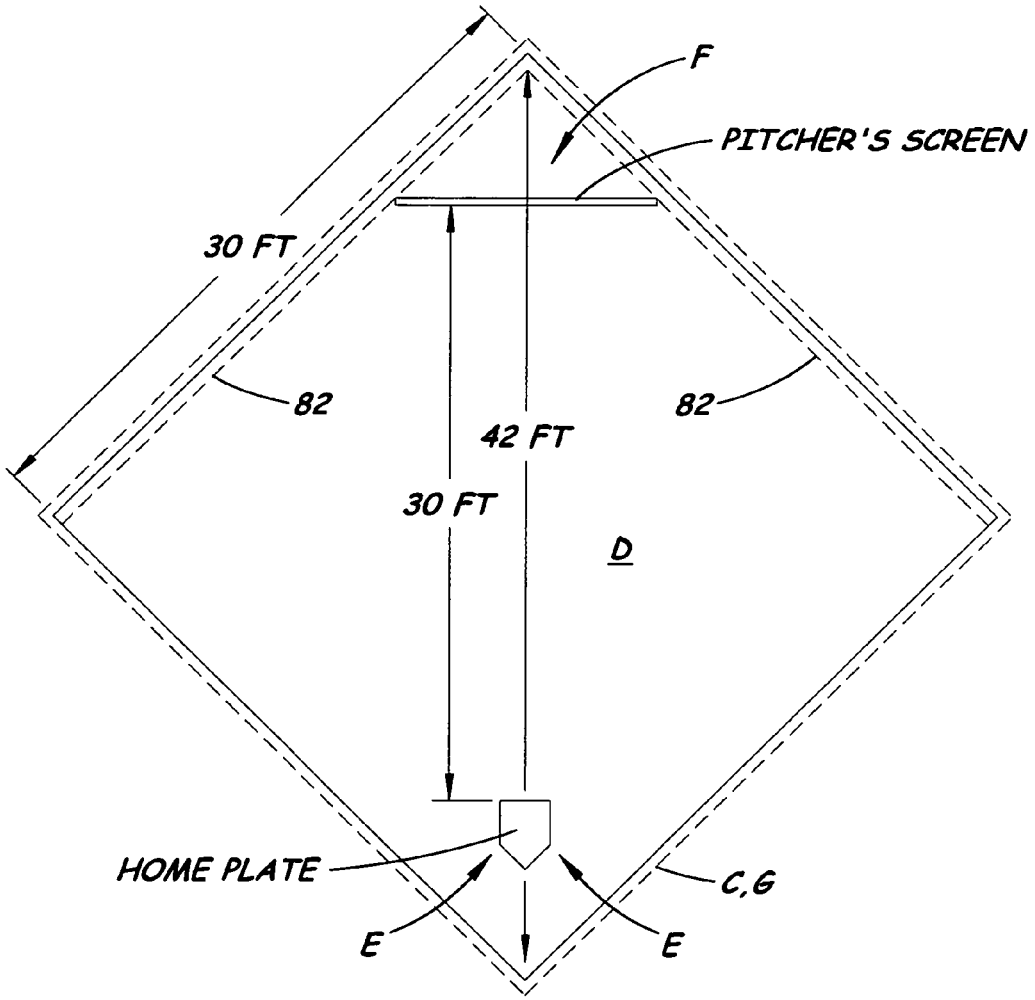
FIG. 7 is a diagrammatic top plan view of one exemplary embodiment of a foreshortened playing field enclosed by the exemplary embodiments of the field view batting cage apparatuses of FIGS. 1 and 4.

The peripheral cable 18 disposed substantially horizontally and laterally between the corner support frame members 14A-14D and extending past the middle support frame members 30A-30D may be anchored thereto by use of any suitable connector devices 36, such as ones including respective rings 38 that allow threading the peripheral cable 18 through the connector devices 36 and to inwardly space the peripheral cable 18, and thereby the vertical walls of netting 26A-26D suspended at short distance inwardly from and within the perimeter C of the respective frame members of the support frame 12, as seen in FIG. 7. Also, using similar connector devices 36 each of the crisscross cables 20A, 20B is strung between the upper end portions 16A, 16C and 16B, 16D of a respective one of two diagonally disposed pairs of the corner support frame members 14A, 14C and 14B, 14D such that crisscross cables 20A, 20B are enabled to suspend and support the ceiling of netting 28 to provide a central dome-shaped configuration, as seen in FIG. 3, at an elevated height above the peripheral cable 18 and extending over the foreshortened baseball playing field D, as seen in FIG. 1.

Figure 4:
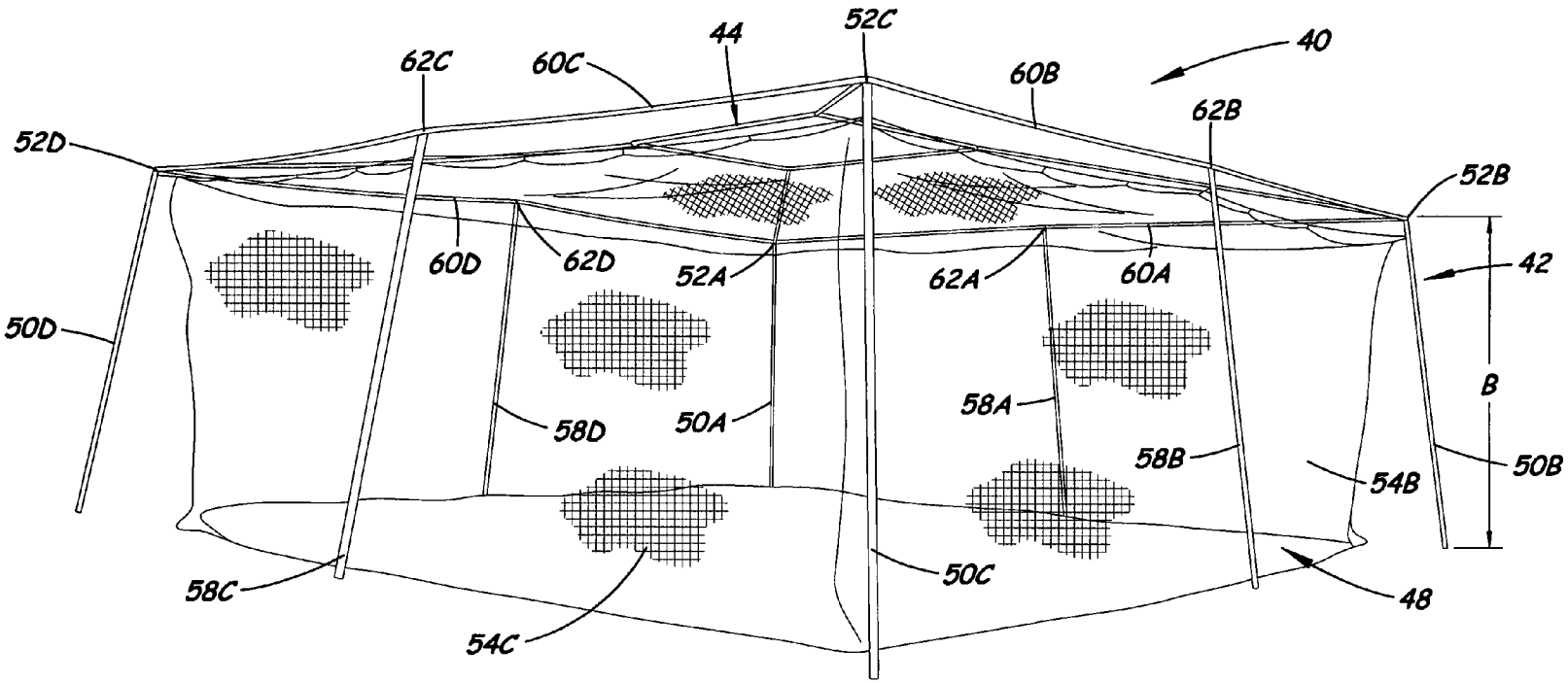
FIG. 4 is a perspective view of another exemplary embodiment of a field view batting cage apparatus in accordance with the present invention.
Figure 5:
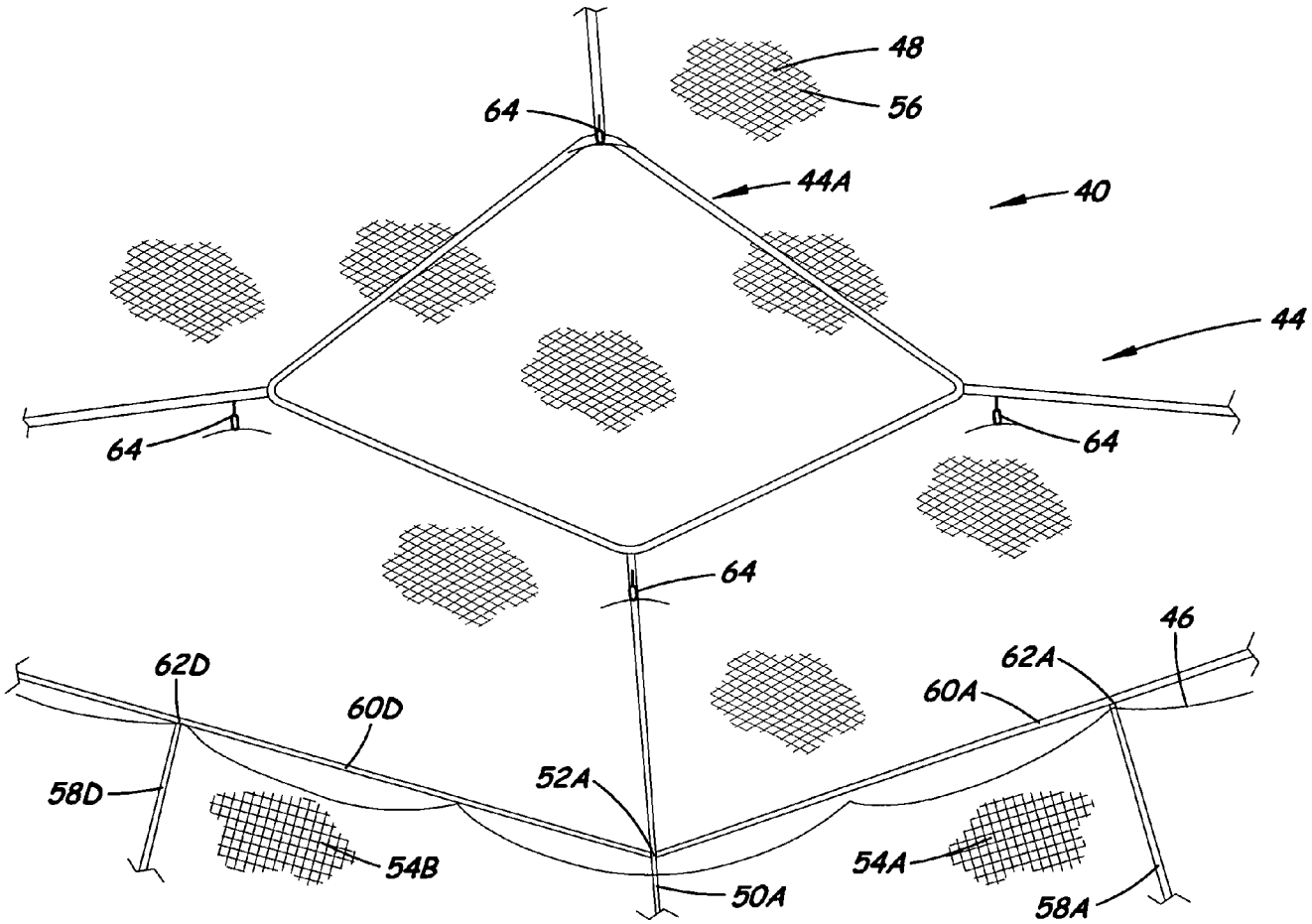
FIG. 5 is an enlarged fragmentary perspective bottom view of the batting cage apparatus of FIG. 4 depicting the underside of a netting of the batting cage apparatus and a roof frame having a dome-shaped configuration that lifts the ceiling of netting into a dome-shaped configuration.
Figure 6A:
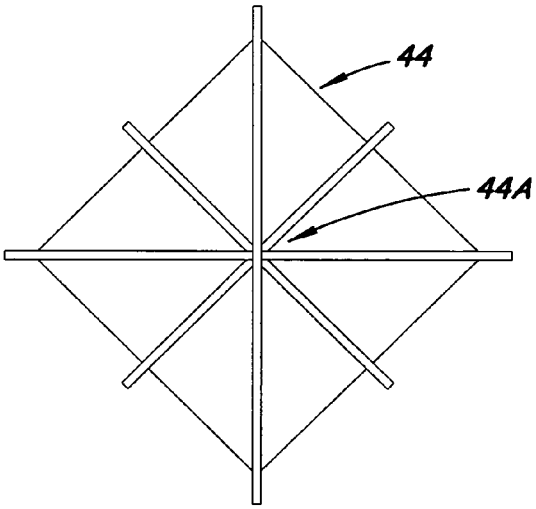
FIGS. 6A-6D are plan views of alternative configurations of the roof frame of the batting cage apparatus of FIG. 4.
Figure 6B:
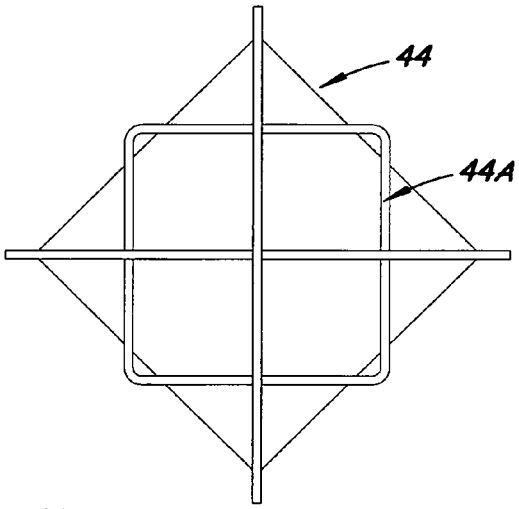
Figure 6C:
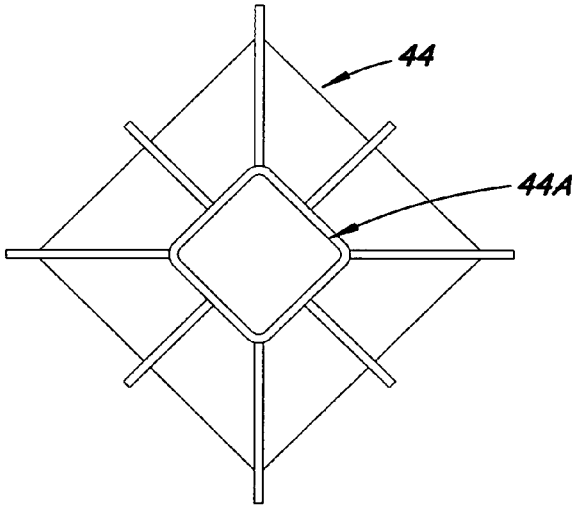
Figure 6D:
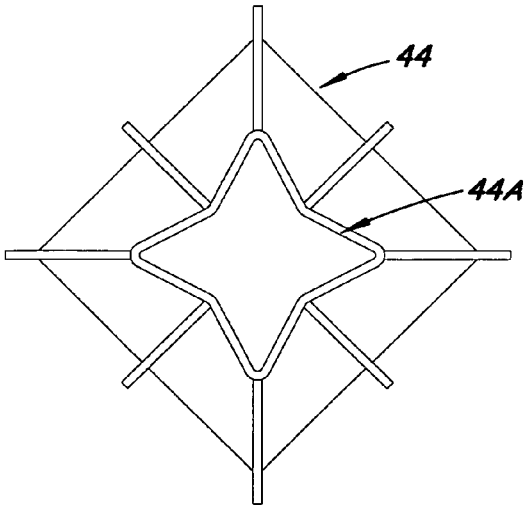

Referring now to FIGS. 4 and 5, there is illustrated another exemplary embodiment of a field view batting cage apparatus, generally designated 40, in accordance with the present invention. The batting cage apparatus 40 includes a support frame 42 adapted to stand upon the support surface A, as best seen in FIG. 4, a roof frame 44 attached to, and spanning the support frame, at least one cable, such being a peripheral cable 46, strung on the support frame 42, and a netting 48 suspended from the at least one cable 46 and the roof frame 44. The support frame 42 has four corners 50A-50D terminating in upper end portions 52A-52D extending upwardly to a given height B above the support surface S. The four corners 50A-50D are arranged in a square configuration defining a perimeter G of the support frame 42 that surrounds the foreshortened baseball playing field D on the support surface A having the one position E disposed adjacent to and spaced inwardly of the corner 50A of the support frame 42 from which to hit a baseball and the other position F disposed adjacent to and spaced inwardly of the corner 50C being diagonally opposite to the one corner 50A from which to pitch a baseball toward the one position E. The roof frame 44 is attached to, and spans between the upper end portions 52A, 52C and 52B, 52D of the diagonally opposite ones of the corners 50A, 50C and 50B, 50D of the support frame 42 such that the roof frame 44 extends in inclined fashion above the given height of the upper end portions 52A-52D of the corners 50A-50D of the support frame 42 to a central portion 44A of the roof frame so as to provide the roof frame 44 with a central elevated dome-shaped configuration spaced above and extending over the foreshortened baseball playing field D.

The suspended netting 48 forms a plurality of vertical walls of netting 54A-54D and a ceiling of netting 56 for providing containment of the ball. The vertical walls of netting 54A-54D are suspended from the peripheral cable 46 so as to extend between and be spaced inwardly from adjacent ones of the upper end portions 52A-52D of the corners 50A-50D and along sides of the support frame 42 such that the vertical walls of netting 54A-54D are spaced inwardly from, and within the perimeter G of, the support frame 42 (see FIG. 7) so as to enclose the foreshortened baseball playing field D. The ceiling of netting 56 is suspended from the roof frame 44 so as to span both laterally and diagonally between the upper end portions 52A-52D of the corners 50A-50D of the support frame 42 such that the ceiling of netting 56 extends from the vertical walls of netting 54A-54D to along and below the roof frame 44 and above the given height of the upper end portions 52A-52D of the corners 50A-50D of the support frame 42 so as to provide a central dome-shaped configuration spaced above and extending over the foreshortened baseball playing field D.

More particularly, the corners 50A-50D of the support frame 42 are in the form of four corner support frame members 50A-50D (such as legs or poles) adapted to stand in an upright inwardly inclined orientations upon the support surface A. The support frame 42 also includes four middle support frame members 58A-58D (such as legs or poles) adapted to stand in upright inwardly inclined orientations upon the support surface A and being disposed intermediately between and spaced from the corner support frame members 50A-50D. The support frame 42 further includes four top support frame members 60A-60D (such as beams) extending horizontally between and fixedly secured to the upper end portions 52A-52D of the corner support frame members 50A-50D. The top support frame members 60A-60D also extend horizontally past and are fixedly secured to the upper portions 62A-62D of the middle support frame members 58A-58D such that the top support frame members 60A-60D together with the upper end portions 52A-52D and 62A-62D of the corner support frame members 50A-50D and middle support frame members 58A-58D are disposed at the given height of the support frame 42 above the support surface A and form the support frame 42 with a rigid structure and the square configuration. The corner, middle and top support frame members 52A-52D, 58A-58D and 60A-60D may be fabricated from any suitable material, by way of example but not of limitation, such as square aluminum or steel tubing. The netting may be forty-two weight poly netting.

The peripheral cable 46 disposed substantially horizontally and laterally between the corner support frame members 50A-50D and extending past the middle support frame members 58A-58D may be anchored thereto by use of any suitable connector devices, such as like the ones used with peripheral cable 18 described hereinabove, that allow threading the peripheral cable 46 through the connector devices and to inwardly space the peripheral cable 46, and thereby suspend the vertical walls of netting 54A-54D at short distance from and within the perimeters C, G of the respective support frames 12, 44, as seen in FIG. 7.

Referring to FIGS. 6A-6D, there are illustrated examples of several different designs the dome-shaped configuration of the roof frame 44 may take. The roof frame 44, being constructed of a plurality of interconnected frame members, for example, may be in the configuration of a single square in FIG. 6A, a star in FIG. 6B, a sparkle of light from a point source in FIG. 6C, or a square box subdivided into quarter-boxes in FIG. 6D.

Figure 8B:
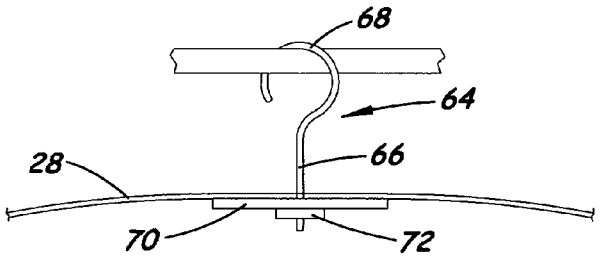
FIGS. 8A and 8B are side elevational views of netting lifter devices used to suspend the ceiling of netting at a central portion thereof in the field view batting cage apparatuses of FIGS. 1 and 4.
Figure 8A:
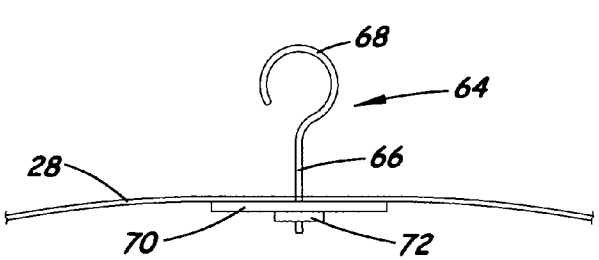

Referring to FIGS. 8A and 8B, there is illustrated one of a plurality of netting lifter devices 64 that may be installed in both embodiments of the batting cage apparatuses 10, 40. The netting lifter devices 64 are attached between the crisscross cables 20A, 20B, or the roof frame 44, and the ceilings of netting 28, 56 at locations adjacent to the central portion thereof so as to maintain the ceilings of netting 28, 56 higher at their central portion than at the walls of netting so as to provide the ceilings of netting 28, 56 with the domed-shape configuration. For example, the dimensions of the playing field D may be 30'W×30'L with a height of twelve feet at the vertical walls of netting 26A-26D, 54A-54D, whereas the height is elevated to fourteen feet at the central portion. Each netting lifter device 64 includes a hanger 66 having a top hook 68 formed on its upper end and a disc-shaped pad 70, such as of rubber, retained by a fastener 72 attached to the lower end of the hanger 66. The top hook 68 inserts through the netting and hooks over the respective cable(s) 20A, 20B or roof frame 44 whereas the bottom disc-shaped pad 70 being greater in size than the openings of the netting will thereby not fit through the openings in the netting but instead will underlie and support the adjacent portion of the respective netting. Preferably, the ceilings of netting 28, 56 are held high at 4-5 points, in the center portion thereof by the lifter devices 64, thereby serving to keep the ceiling of netting high enough to prevent the netting from drooping down and obstructing batted balls.

Figure 9:
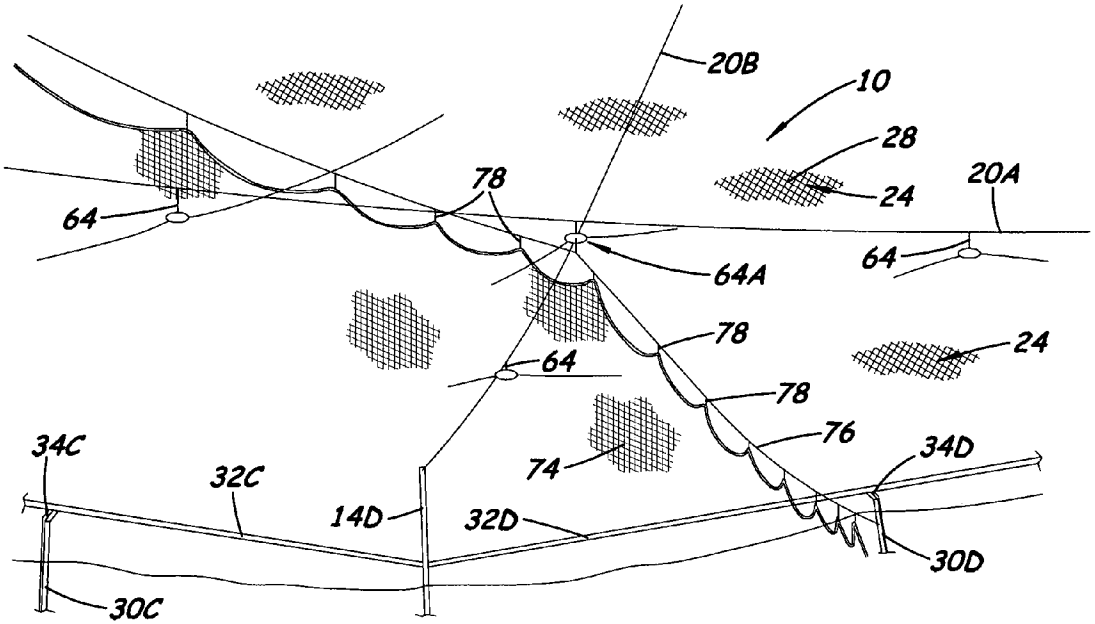
FIG. 9 is an fragmentary perspective bottom view of the batting cage apparatus of FIG. 1 depicting a cage divider netting suspended and extended across the batting cage apparatus from a divider netting cable.

Referring to FIG. 9, there is illustrated a cage divider "curtain-like" netting 74 that may be deployed in both embodiments of the batting cage apparatuses 10, 40, in order to divide them, for example, from a 30'×30' unit to two 15'×30' units. As shown in conjunction with the batting cage apparatus 10, the divider netting 74 may be suspended from a divider cable 76 tautly stretched between either of the pairs of opposing middle support frame members 30A, 30C and 30B, 30D.

Figure 9A:
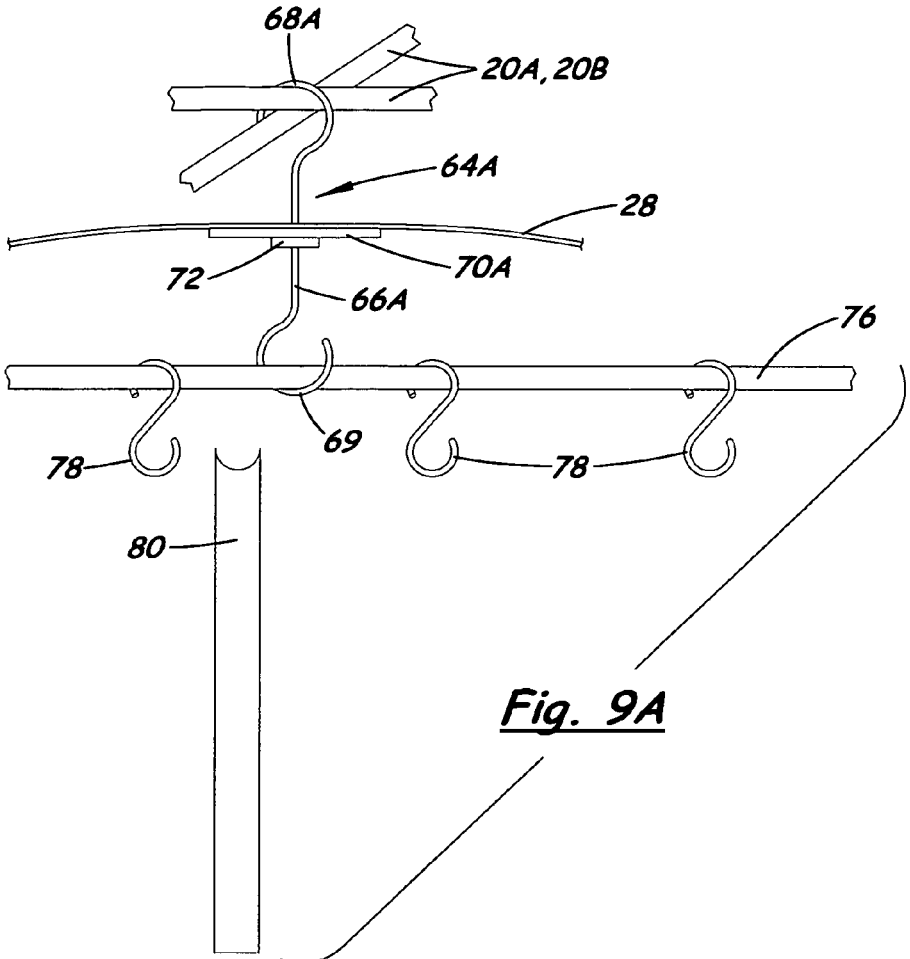
FIGS. 9A and 9B are side elevational view the attaching and detaching of the divider netting to and from the divider netting cable.
Figure 9B:
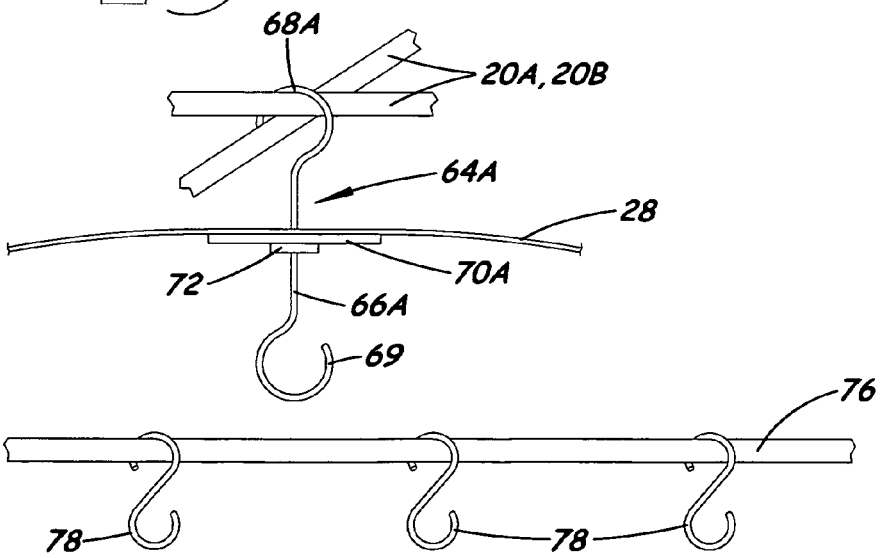

Referring to FIGS. 9A and 9B, the divider cable 76 may also be attached to the crisscross cables 20A, 20B at their crossing point by a netting lifter device 64A also having a bottom hook 68A formed on its lower end spaced below the disc-shaped pad 70A. The divider netting 74 is suspended from the divider cable 76 by spaced apart S-shaped hooks 78. When storage of the divider netting 74 is desired, the divider cable 76 first must be lifted by using a tool 80 to unhook the cable 76 from the bottom hook 68A on the one netting lifter device 64A hooked at the crossing point of the crisscross cables 20A, 20B. Then, the divider netting 74 may be slid to and gathered adjacent to selected one of the vertical walls of netting 26A-26D when not in use.

Figure 10:
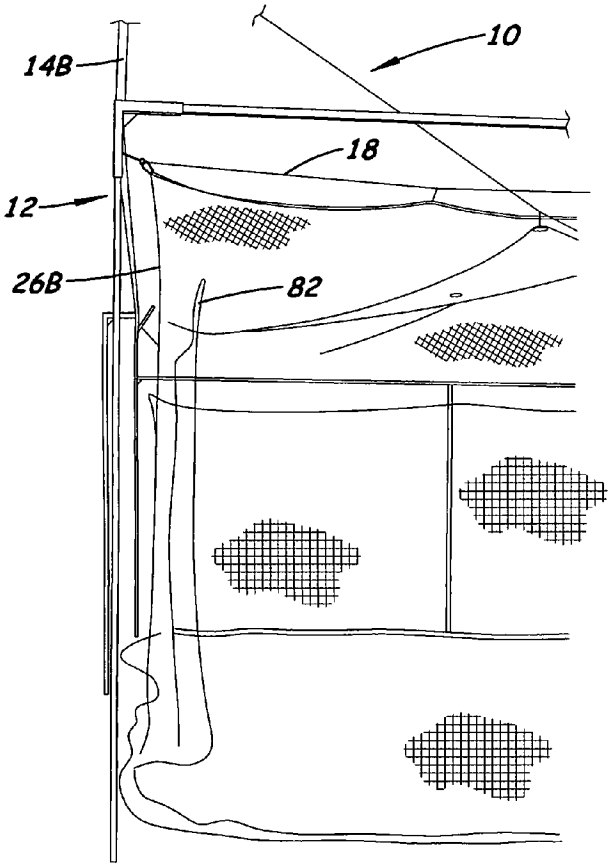
FIG. 10 is a perspective view of a portion of a corner of either of the batting cage apparatuses depicting a baffle netting vertically suspended from the ceiling of netting and spaced inwardly from the adjacent one of the pair of vertical walls of netting facing toward the hitting position of the playing field.

Referring now to FIG. 10, there is illustrated a baffle netting 82 that may be installed in both embodiments of the batting cage apparatuses 10, 40. As shown in conjunction with the batting cage apparatus 10, the baffle netting 82 is vertically suspended from the ceiling of netting 28 and spaced inwardly from a pair of the vertical walls of netting 26B-26C extending in opposite directions from the pitching position F and facing toward the hitting position E. By way of example, the baffle netting 82 preferably is disposed approximately one to two feet inside of the vertical walls of netting and runs from corner to corner of what is the "outfield" sides of the cage, or the area in the direction in which baseballs are batted. The purpose of the baffle netting 82 is to provide a protective netting barrier to protect the outer vertical walls of netting 26B-26C by absorbing the energy of impact by a hit baseball and thereby extend the life of the outer vertical walls of netting by reducing the amount of stress, wear and tear due to direct impact of the hit baseball. The baffle netting 82 is only secure at its top; it is free at its sides and bottom.

Figure 11:
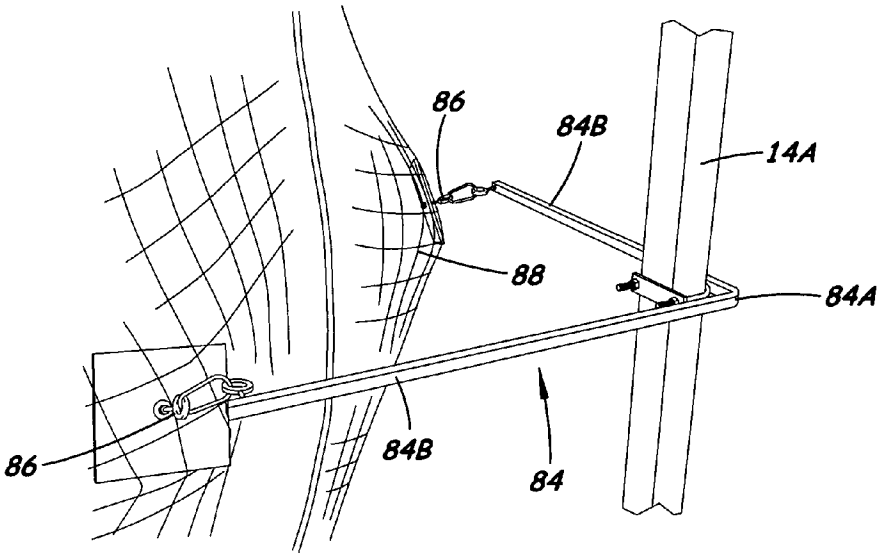
FIG. 11 is an enlarged perspective view of a portion of a corner of either of the batting cage apparatuses depicting a V-shaped corner device secured between a corner of netting and a corner support frame member.

Referring to FIG. 11, there is illustrated a corner device 84 that may be installed in both embodiments of the batting cage apparatuses 10, 40. As shown in conjunction with the batting cage apparatus 10, the corner device 84 has a right angular shaped configuration defining a bight portion 84A and a pair of end portions 84B. The bight portion 84A of the corner device 84 fits about an outer side of, and secures to, the respective corner support frame member 14A of the batting cage apparatus 10 adjacent to the hitting position E. The end portions 84B of the corner device 84 are spaced apart from each other through 90° so as to be disposed in opposite 90° lateral directions from the respective one corner support frame member 14A. The end portions 84B are secured by connectors 86 to a corner of netting 88 formed between a pair of the vertical walls of netting 26A, 26D adjacent to the respective one corner support frame member 14A of the batting cage apparatus 10. The corner device 84 will serve to flatten and spread out the netting of the corner 88 to thereby make it a broader space for the batter to swing the bat and to allow the hitting position E to be placed closer to the respective flatten corner of netting and thereby lengthen the distance between the hitting and pitching positions E, F. The corner device 84 may also be used in the opposite corner adjacent to the pitching position F to add space for the pitcher to throw the ball.

Referring now to FIGS. 12A-12E, there is shown a plurality of visual teaching and training aids that are used in conjunction with both of the batting cage apparatuses 10, 40 that provide instant feedback and guidance during batting and bunting drills. As shown in conjunction with the batting cage apparatus 10, various ones of the visual training guides are mounted on the pair of vertical walls of netting 26B, 26C extending in opposite directions from the pitching position F and facing toward the hitting position E.

Figure 12A:
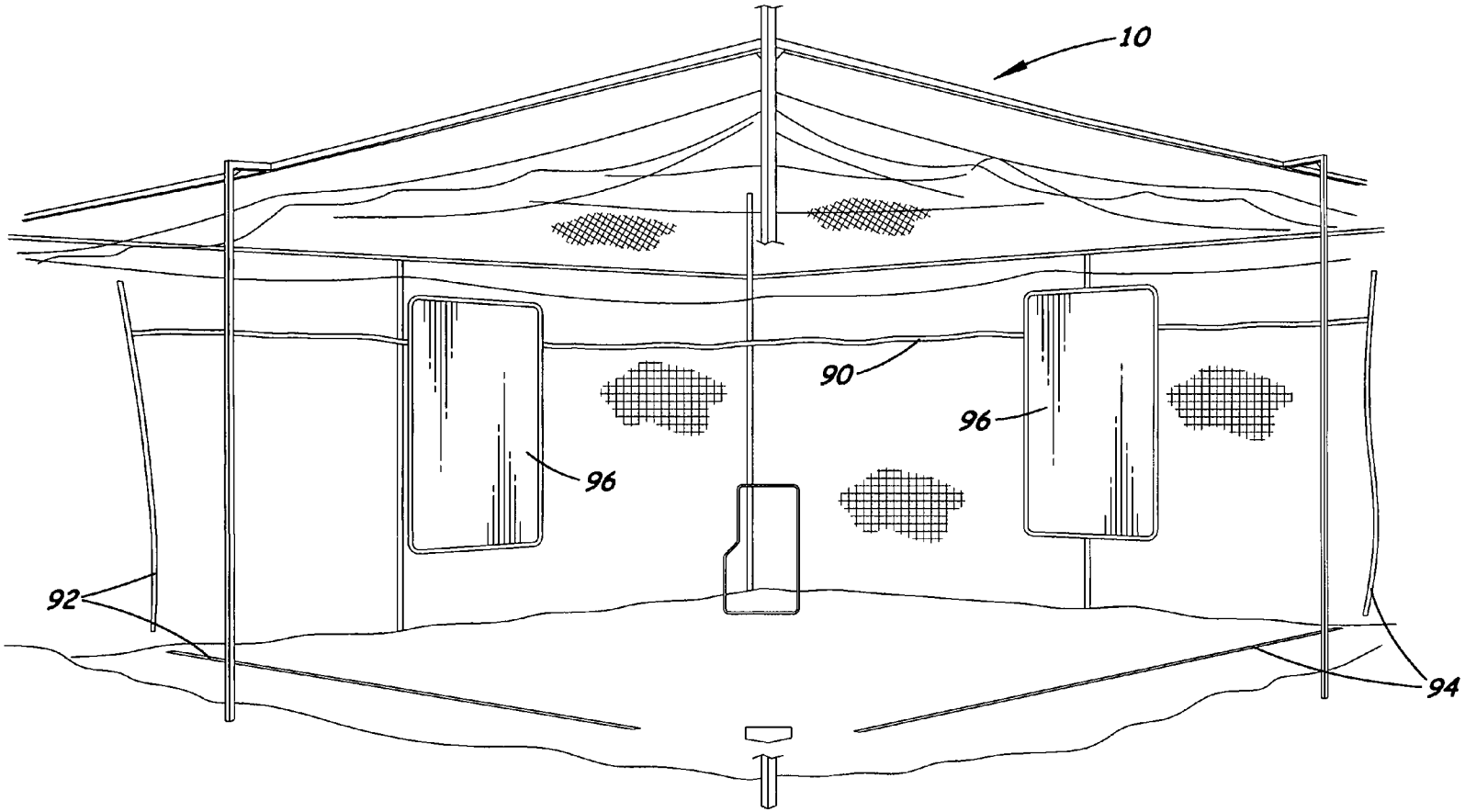
FIGS. 12A-12E are perspective views of a plurality of visual training aids deployed on either of the batting cage apparatuses and foreshortened playing field for teaching batters how to hit and bunt.

FIG. 12A shows a horizontal homerun power line marker 90, and left and right foul line markers 92, 94. The latter enable a batter to promptly determine the trajectory and location of a hit ball and whether the hit ball is fair or foul thereby helping batters to learn proper timing to keep the ball in fair territory. Accurate feedback provided to hitters by these markers 90-94 is not possible in the standard or traditional tunnel batting cages such that the batter must guess whether a ball had an acceptable line drive trajectory and whether the ball would have been fair or foul when it was hit.

Figure 13:
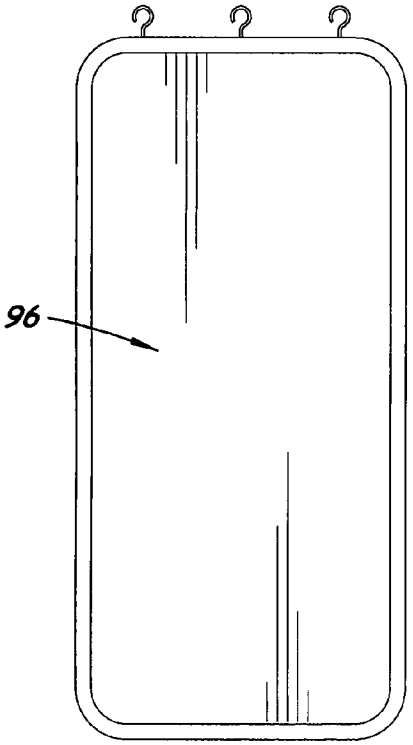
FIG. 13 is an enlarged front view of a gap marker being one of the visual training aids of FIG. 12.

Also as seen in FIG. 12A, the visual training guides include multi-purpose gap markers 96 disposed in gap positions between outfielders (cut-outs of players in the field can be employed to simulate real-life situations for batters). FIG. 13 shows an exemplary embodiment of a multi-purpose gap marker 96. The gap markers 96 serve to help batters learn gap hitting timing.

Figure 12B:
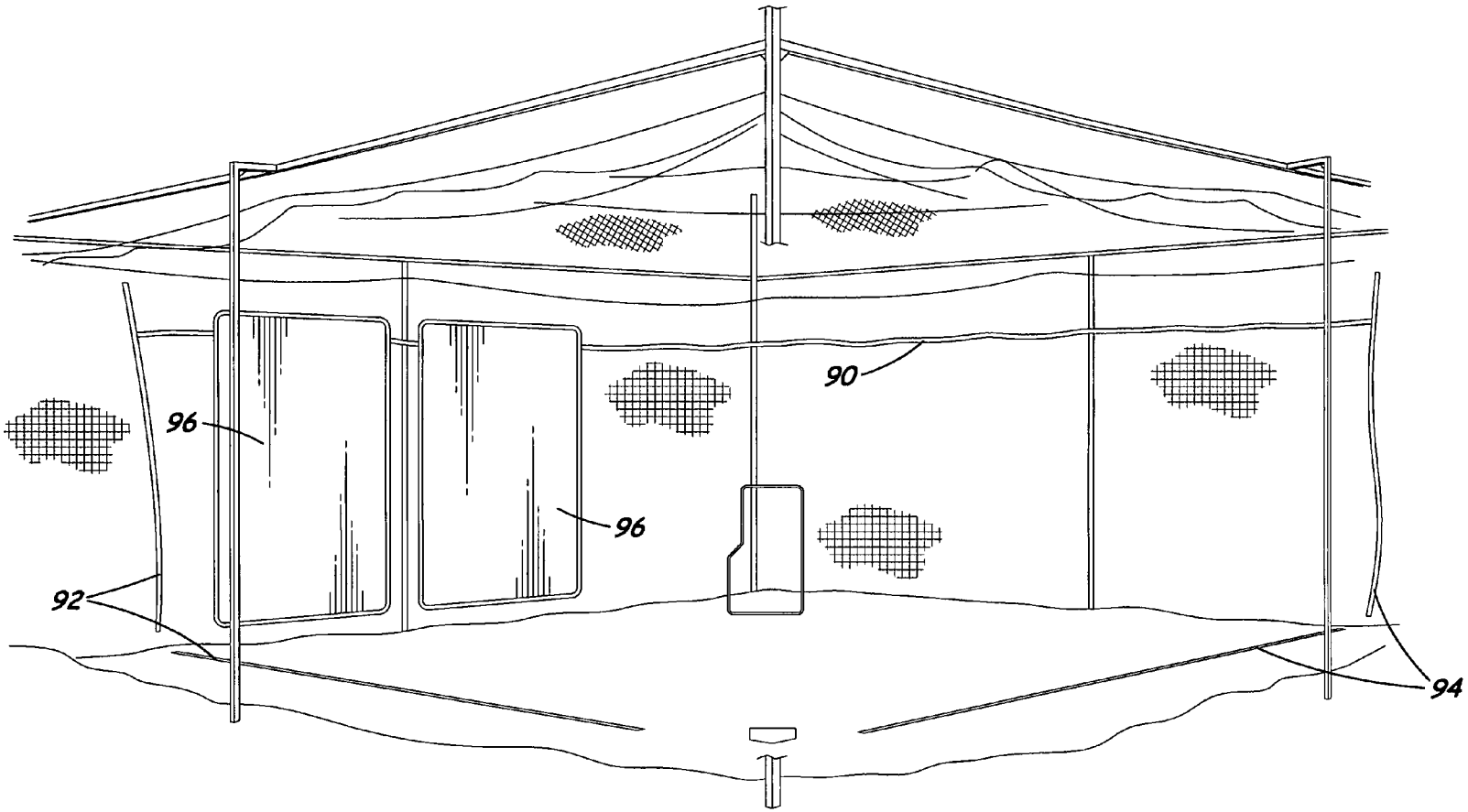
Figure 12C:
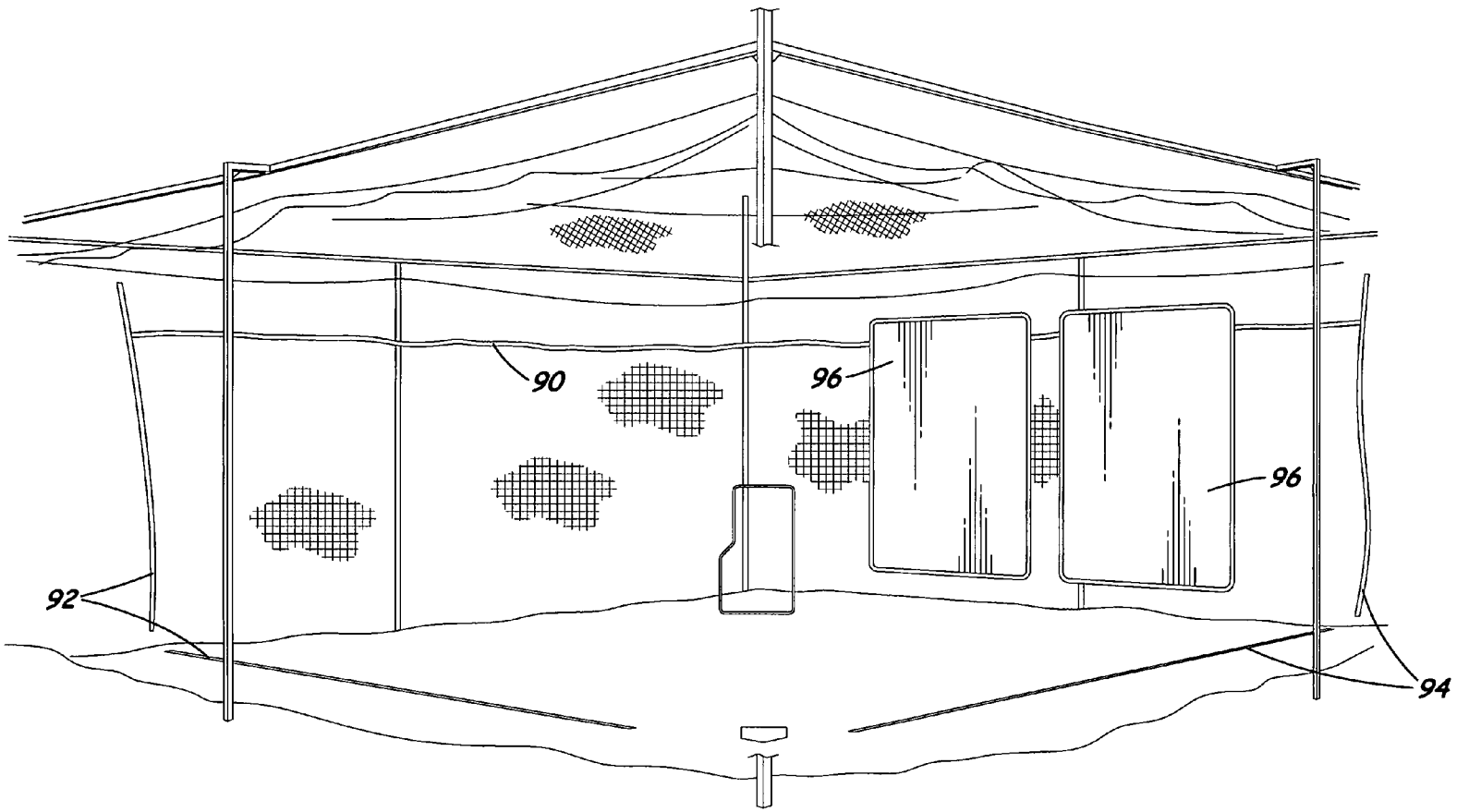
Figure 12D:
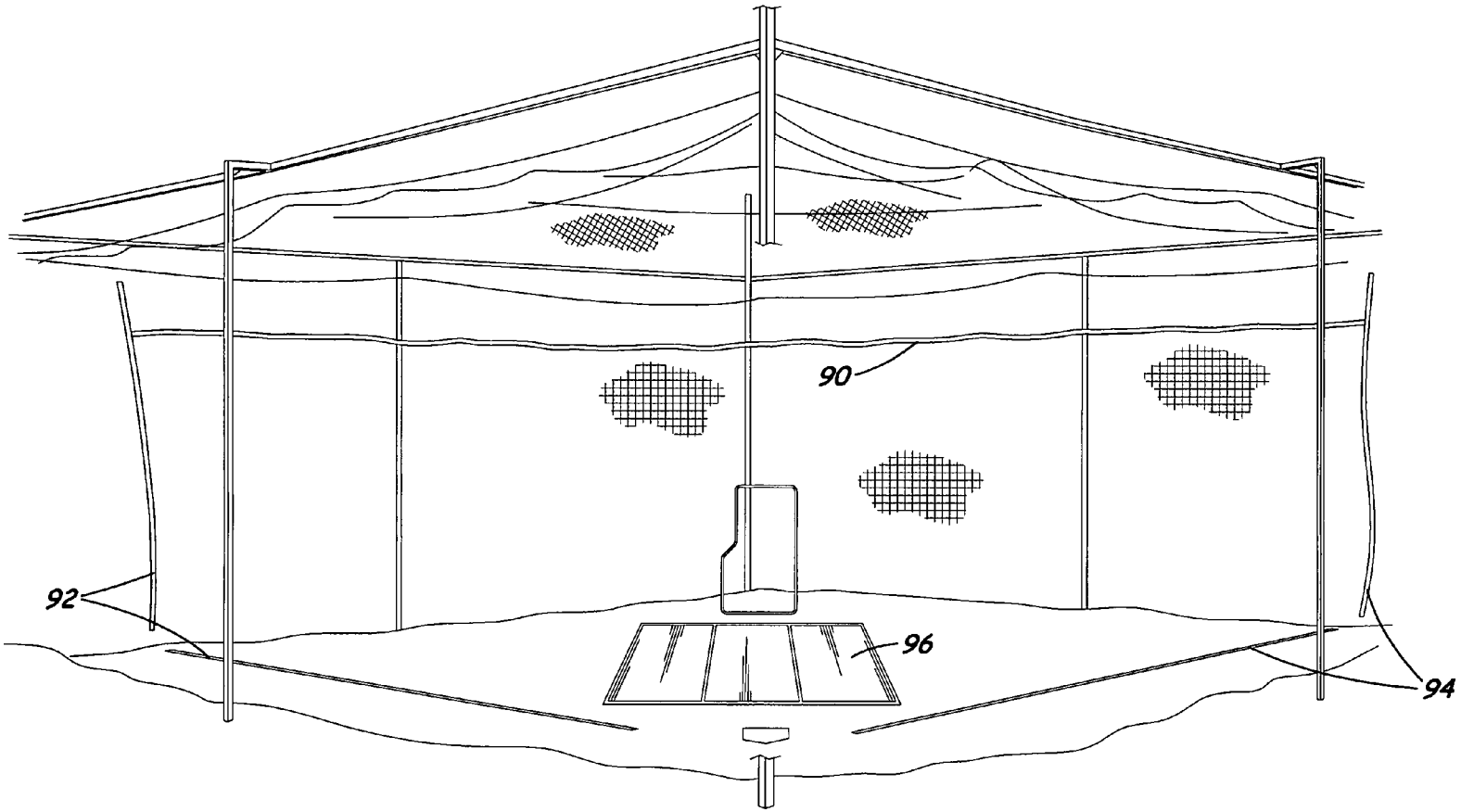
Figure 12E:
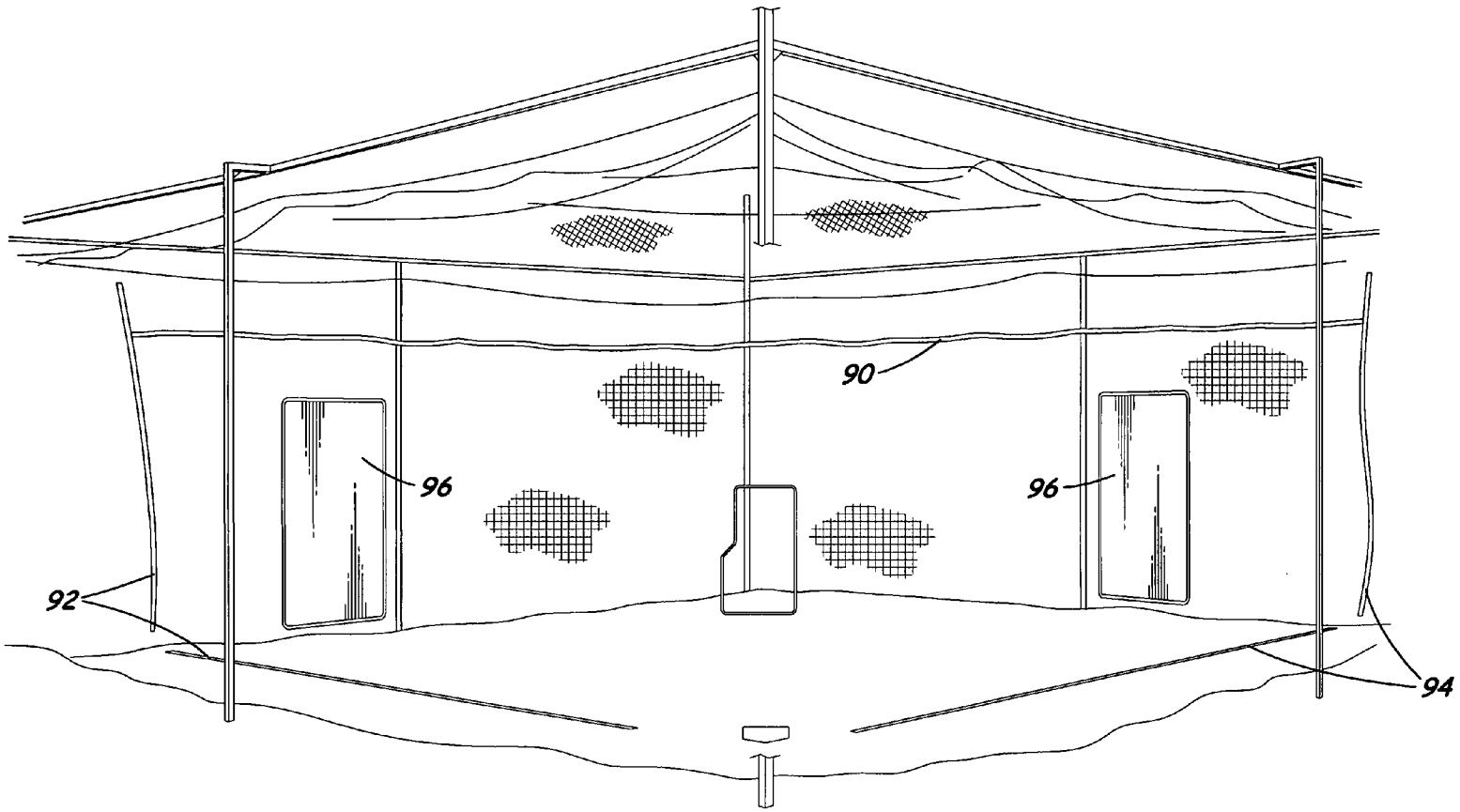

As shown in FIGS. 12B-12E, the gap markers 96 are multi-purpose in that it can be used as teaching aids in multiple hitting and bunting drills. In FIGS. 12B and 12C, the gap markers 96 are used in the "oppo" drill position respectively for right-handed and left-handed batters. "Oppo" means that the batter cannot pull the ball, but must rather hit the ball to the opposite field. In FIG. 12D, the gap markers 96 are laid flat on the ground for bunting drills. They are placed here for the purpose of teaching batters where to and where not to bunt the ball. In this configuration the batter is instructed to bunt the ball away from the marked area to keep the bunted ball away from the pitcher to prevent the pitcher from quickly fielding the ball. Avoiding this area gives the batter higher odds of reaching first base safely. In FIG. 12E, the gap markers 96 are shown in the "slap hitting" practice positions. Slap hitting is employed in fast pitch softball. This popular and highly acclaimed technique of hitting is impossible to practice in a batting cage of standard or traditional shape. Field view batting cage apparatuses 10, 40 are ideal for practicing slap hitting because the batters can see the foul lines and have enough room to exit the batters box and move down the baseline toward first base.

Figure 14C:
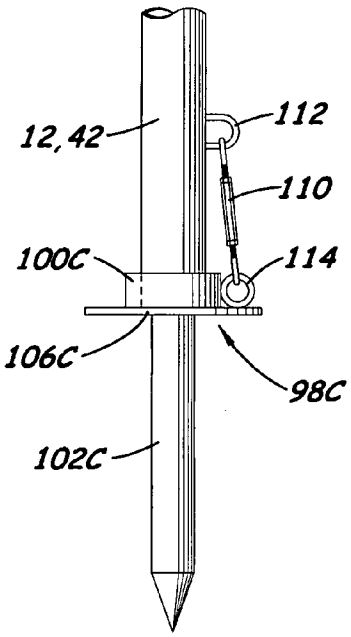
FIGS. 14A-14C are elevational views of exemplary embodiments of three versions of a plurality of support frame member anchor devices that can be used to secure the support frames of either of the batting cage apparatuses to a support surface.
Figure 14B:
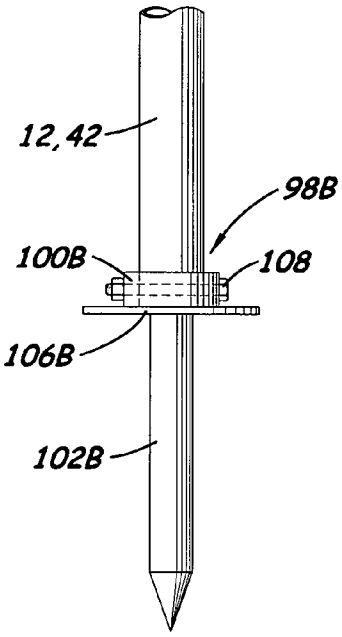
Figure 14A:
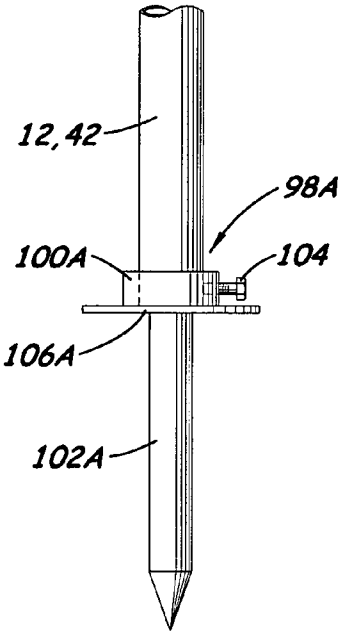

Referring lastly to FIGS. 14A-14C, both of the batting cage apparatuses 10, 40 may also include a plurality of support frame member anchor devices 98A-98C for securing or anchoring the apparatuses 10, 40 to the support surface A so as to prevent being damaged by high winds or storms and also to prevent the support frame members over time from sinking in the support surface, such as the ground, such to the weight of the apparatuses. The anchor devices 98A-98C support the frame members (poles or legs) so as to prevent them from sinking into the ground, hold and anchor them in place during high winds, and are user friendly when it comes to installation and removal.

More particularly, each of the support frame member anchor devices 98A-98C includes a respective receiver housing 100A-100C, which can be round or square, and a respective elongated stake 102A-102C fixedly attached to an underside of the receiver housing 100A-100C. The respective receiver housing 100A-100C is adapted to receive and attach to a lower end portion of a respective one of the corner and middle support frame members of the support frames 12, 42 so as support the frame members thereof from sinking into the support surface A. The elongated stake 102A-102C is adapted to be driven into the support surface A and thereby secure the respective frame members of the support frames 12, 42 to the support surface A.

As seen in FIG. 14A, the frame member or leg of the support frame 12, 42 is held securely in place by screwing a set screw 104 through a threaded hole in the side of the receiver housing 100A of the anchor device 98A that tightens onto the side of the support member of the support frame 12, 42, thus forming a locking connection with it. As seen in FIGS. 14A-14C, flat plates 106A-106C are affixed onto the bottom of the respective receiver housings 100A-100C to prevent the respective anchor devices 98A98C from sinking into the ground. Each of the stakes 102A-102C may have a pointed end and be twelve inches in length, although it may be somewhat longer or shorter.

As seen in FIG. 14B, the frame member or leg of the support frame 12, 42 has a hole drilled completely through it from side to side. The receiver housing 100B of the anchor device 98B has oppositely aligned holes drilled through it so that a bolt or pin 108 may be inserted through the frame member of the support frame 12, 42 and threaded into the receiver housing 100B to lock the frame securely to the anchor device 98B.

As seen in FIG. 14C, a turnbuckle 110 of the anchor device 98C hooks onto respective rings 112, 114 on the frame member of the support frame 12, 42 and the receiver housing 100C. Then, the turnbuckle 110 is turned until the connection is tightened and secure.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A field view batting cage apparatus, comprising:

a support frame adapted to stand upright upon a support surface and having four corners with upper end portions at a given height above said support surface and in a square configuration defining a perimeter of said support frame that surrounds a foreshortened baseball playing field on the support surface having one position disposed adjacent to and spaced inwardly of one of said corners from which to hit a baseball and another position disposed adjacent to and spaced inwardly of another of said corners being diagonally opposite to said one corner from which to pitch a baseball toward said one position;

a plurality of cables strung on said support frame; and a netting suspended from said support frame by said plurality of cables for providing containment of the baseball, said suspended netting forming four vertical walls of netting suspended from at least one of said cables so as to extend between adjacent ones of said corners and along sides of said support frame such that said vertical walls of netting are inwardly spaced from, and within said perimeter of, said support frame so as to enclose four sides of the foreshortened baseball playing field, and a ceiling of netting suspended from others of said cables so as to span both laterally and diagonally between said upper end portions of said corners of said support frame and from said vertical walls of netting such that a central area of said ceiling of netting extends toward said given height of said upper end portions of said corners of said support frame so as to have a central dome-shaped configuration spaced above and extended over the foreshortened baseball playing field.

2. The apparatus of claim 1 wherein said plurality of cables includes a peripheral cable anchored to and running substantially horizontally and laterally between said corners of said support frame such that said peripheral cable defines a square configuration spaced inwardly from and within said square configuration of said support frame and suspends said vertical walls of netting inwardly spaced from, and within said perimeter of, said support frame.

3. The apparatus of claim 1 further comprising a plurality of visual training aids mounted on one of the playing field and a pair of said vertical walls of netting extending in opposite directions from said pitching position and facing toward said hitting position, said visual training aids being at least one of a horizontal homerun line marker, markers disposed in gap positions for batting and bunting guidance, and left and right foul line markers, said markers enabling a batter to promptly determine the trajectory and location of a hit ball and whether the hit ball is fair or foul.

4. The apparatus of claim 1 further comprising a baffle netting vertically suspended from said ceiling of netting and spaced inwardly from a pair of said vertical walls of netting extending in opposite directions from said pitching position and facing toward said hitting position such that said baffle netting absorbs the energy of impact by a hit ball and thereby protects said pair of said vertical walls of netting from wear and tear due to direct impact of the hit ball.

5. The apparatus of claim 1 wherein said plurality of cables further includes a pair of crisscross cables each being strung between one of two diagonally disposed pairs of said corners of said support frame such that said crisscross cables support said ceiling of netting extending above and over the foreshortened baseball playing field.

6. The apparatus of claim 1 wherein said corners of said support frame are corner support frame members adapted to stand upright upon the support surface.

7. The apparatus of claim 6 further comprising a corner device having a right angular shaped configuration defining:

a bight portion at which said corner device fits about an outer side of, and secures to, a respective one of said corner support frame members adjacent to at least said hitting position; and a pair of end portions spaced apart from each other and disposed in opposite lateral directions from said respective one corner support frame member, said end portions of said corner device being secured to a corner of netting formed between a pair of said vertical walls of netting adjacent said respective one corner support frame member so as to flatten and spread out said netting of said corner to thereby allow the one of said hitting and pitching positions to be placed closer to said flatten corner of said netting so as to lengthen the distance between the hitting and pitching positions.

8. The apparatus of claim 6 wherein said support frame further comprises a plurality of middle support frame members adapted to stand upright upon the support surface and being disposed intermediately between and spaced from said corner support frame members.

9. The apparatus of claim 8 further comprising a plurality of anchor devices, each of said anchor devices including:

a receiver housing adapted to receive and attach to a lower end portion of a respective one of said corner and middle support frame members so as support said one pole from sinking into the support surface; and an elongated stake fixedly attached to an underside of said receiver housing and adapted to be driven into the support surface to thereby secure the respective one of the corner and middle support frame members to the support surface.

10. The apparatus of claim 8 wherein said support frame further comprises a plurality of top support frame members extending horizontally between and fixedly secured to said corner support frame members at locations spaced below said upper end portions thereof, said top support frame members also extending horizontally past and fixedly secured to said middle support frame members at said upper end portions thereof such that said top support frame members together form said square configuration of said support frame.

11. The apparatus of claim 10 wherein said plurality of cables includes a peripheral cable running substantially horizontally and laterally between said corner support frame members and past said middle support frame members and being anchored to said support frame at locations spaced below said locations at which said top support frame members are secured to said corner support frame members and at locations proximate to said upper end portions of said middle support frame members thereof and said top support frame members thereof such that said peripheral cable defines a square configuration spaced inwardly from and within said square configuration of said support frame and suspends said vertical walls of netting inwardly spaced from, and within said perimeter of, said support frame.

12. The apparatus of claim 11 wherein said plurality of cables further includes a pair of crisscross cables each being strung between one of two diagonally disposed pairs of said corner support frame members at said upper end portions thereof such that said pair of crisscross cables extend above said top support frame members and said upper end portions of said middle support frame members so as to support at least a central portion of said ceiling of netting above said middle support frame members and said top support frame members and over the foreshortened baseball playing field.

13. The apparatus of claim 12 further comprising a plurality of net lifting devices hanging from said crisscross cables and attached between said crisscross cables and said ceiling of netting at locations closer to said central portion thereof than to said corner support frame members so as to maintain said central portion of said ceiling of netting higher than side portions thereof to provide said ceiling of netting with a domed configuration.

14. The apparatus of claim 13 further comprising:

a divider cable attached to said support frame and to one of said net lifting devices hanging from said crisscross cables at a crossing point thereof such that said divider cable extends between a pair of opposite ones of said middle support frame members; and a divider netting suspended from said divider cable and slidable between a storage position in which said divider netting is gathered adjacent to a selected one of said vertical walls of netting and a deployed position in which said divider netting divides the playing field into two halves.

15. A field view batting cage apparatus, comprising:

a support frame adapted to stand upon a support surface and having four corners with upper end portions at a given height above the support surface and in a square configuration defining a perimeter of said support frame that surrounds a foreshortened baseball playing field on the support surface having one position disposed adjacent to and spaced inwardly of one of said corners from which to hit a baseball and another position disposed adjacent to and spaced inwardly of another of said corners being diagonally opposite to said one corner from which to pitch a baseball toward said one position;

a roof frame attached to, and spanning between diagonally opposite ones of, said upper end portions of said corners of said support frame such that said roof frame extends above said given height of said upper end portions of said corners of said support frame so as to have a central dome-shaped configuration spaced above and extended over the foreshortened baseball playing field;

at least one cable strung on said support frame; and a netting suspended from said at least one cable and from said roof frame for providing containment of the baseball, said suspended netting forming four vertical walls of netting suspended from said at least one cable so as to extend between adjacent ones of said upper end portions of said corners and along sides of said support frame such that said vertical walls of netting are inwardly spaced from, and within said perimeter of, said support frame so as to enclose four sides of the foreshortened baseball playing field, and a ceiling of netting suspended from said roof frame so as to span both laterally and diagonally between said upper end portions of said corners of said support frame such that said ceiling of netting extends from said vertical walls of netting along and below said roof frame and above said given height of said upper end portions of said corners of said support frame so as to have a central dome-shaped configuration spaced above and extending over the foreshortened baseball playing field.

16. The apparatus of claim 15 wherein said roof frame includes a central portion of interconnected frame members in the configuration of one of a square, a star and a sparkle of light from a point source.

17. The apparatus of claim 16 wherein said roof frame further includes a plurality of frame members interconnecting and extending radially outwardly between said central portion and upper end portions of at least said corners of said support frame.

18. The apparatus of claim 15 wherein said at least one cable is a peripheral cable anchored to and running substantially horizontally and laterally between said upper end portions of said corners of said support frame such that said peripheral cable defines a square configuration spaced inwardly from and within said square configuration of said support frame and vertically suspends said vertical walls of netting inwardly spaced from, and within said perimeter of, said support frame.

19. The apparatus of claim 15 further comprising a plurality of visual training aids mounted on one of the playing field and a pair of said vertical walls of netting extending in opposite directions from said pitching position and facing toward said hitting position, said visual training aids being at least one of a horizontal homerun line marker, markers disposed in gap positions for batting and bunting guidance, and left and right foul line markers, said markers enabling a batter to promptly determine the trajectory and location of a hit ball and whether the hit ball is fair or foul.

20. The apparatus of claim 15 further comprising a baffle netting vertically suspended from said ceiling of netting and spaced inwardly from a pair of said vertical walls of netting extending in opposite directions from said pitching position and facing toward said hitting position such that said baffle netting absorbs the energy of impact by a hit ball and thereby protects said pair of said vertical walls of netting from wear and tear due to direct impact of the hit ball.

21. The apparatus of claim 15 further comprising a plurality of net lifting devices attached between said roof frame and said ceiling of netting at locations closer to a central portion of said roof frame than to said corners of said support frame so as to maintain said central portion of said ceiling of netting higher than side portions thereof so as to provide said ceiling of netting with said domed-shaped configuration above and over the foreshortened baseball playing field.

22. The apparatus of claim 15 wherein said corners of said support frame are corner support frame members adapted to stand in upright inwardly inclined orientations upon the support surface.

23. The apparatus of claim 22 further comprising a corner device having a right angular shaped configuration defining:

a bight portion at which said corner device fits about an outer side of, and secures to, a respective one of said corner support frame members adjacent to at least the hitting position; and a pair of end portions spaced apart from each other and disposed in opposite lateral directions from said respective one corner support frame member, said end portions of said corner device being secured to a corner of said netting formed between a pair of said vertical walls of netting adjacent said respective one corner support frame member so as to flatten and spread out said netting of said corner to thereby allow said hitting position to be placed closer to said flatten corner of said netting so as to lengthen the distance between the hitting and pitching positions.

24. The apparatus of claim 22 wherein said support frame further comprises a plurality of middle support frame members adapted to stand in upright inwardly inclined orientations upon the support surface and being disposed intermediately between and spaced from said corner support frame members.

25. The apparatus of claim 24 further comprising a plurality of anchor devices, each of said anchor devices including:

a receiver housing adapted to receive and attach to a lower end portion of one of said corner and middle support frame members so as support said one support frame member from sinking into the support surface; and an elongated stake fixedly attached to an underside of said receiver housing and adapted to be driven into the support surface.

26. The apparatus of claim 24 wherein said support frame further comprises a plurality of top support frame members extending horizontally between and fixedly secured to said upper end portions of said corner support frame members, said top support frame members also extending horizontally past and fixedly secured to upper end portions of said middle support frame members such that said top support frame members together with said upper end portions of said corner and middle support frame members form said square configuration of said support frame and are disposed at said given height of said support frame.

27. The apparatus of claim 26 wherein said at least one cable includes a peripheral cable running substantially horizontally and laterally between said corner support frame members and past said middle support frame members and being anchored to said support frame proximate to said upper end portions of said corner and middle support frame members thereof and said top support frame members thereof such that said peripheral cable defines a square configuration spaced inwardly from and within said square configuration of said support frame and suspends said vertical walls of netting inwardly spaced from, and within said perimeter of, said support frame.

28. The apparatus of claim 27 wherein said central portion of said roof frame is provided by a plurality of frame members interconnected in the configuration of a rectangle.

29. The apparatus of claim 28 wherein said roof frame includes an additional plurality of frame members interconnecting and extending radially outwardly between said central portion and upper end portions of at least said corner support frame members.

30. The apparatus of claim 24 further comprising:

a divider cable attached to said support frame and to said roof frame such that said divider cable extends between a pair of opposite ones of said middle support frame members; and a divider netting suspended from said divider cable and slidable between a storage position in which said divider netting is gathered adjacent to a selected one of said vertical walls of netting and a deployed position in which said divider netting divides the playing field into two halves.

* * * * *